US006225268B1

(12) United States Patent
Chang et al.

(10) Patent No.: US 6,225,268 B1
(45) Date of Patent: May 1, 2001

(54) LIQUID DETERGENT COMPOSITION

(75) Inventors: Mao-Tung Chang, Nantou Hsien; Chiun-Chyi Chang, Taichung, both of (TW)

(73) Assignee: Sinon Corporation, Taichung (TW)

( * ) Notice: Subject to any disclaimer, the term of this patent is extended or adjusted under 35 U.S.C. 154(b) by 0 days.

(21) Appl. No.: 09/378,925

(22) Filed: Aug. 23, 1999

(51) Int. Cl.[7] ..... C11D 3/18; C11D 3/43

(52) U.S. Cl. ..... 510/111; 510/220; 510/221; 510/226; 510/229; 510/235; 510/405; 510/479; 510/488

(58) Field of Search ..... 510/111, 220, 510/221, 226, 229, 230, 405, 479, 488

(56) References Cited

U.S. PATENT DOCUMENTS

| | | | | |
|---|---|---|---|---|
| 4,140,649 | * | 2/1979 | Bossert et al. | 252/105 |
| 4,808,330 | * | 2/1989 | Chung | 252/170 |
| 5,456,850 | * | 10/1995 | Trabitzsch et al. | 252/97 |
| 6,034,271 | * | 3/2000 | Kwetkat | 562/565 |

* cited by examiner

*Primary Examiner*—Kery Fries
(74) *Attorney, Agent, or Firm*—Banner & Witcoff Ltd

(57) ABSTRACT

A liquid detergent composition contains (1) 0.5 to 5% by weight of citrate, (2) 0.5 to 10% by weight of alcohol, (3) 5 to 15% by weight of cocinin, and (4) 70 to 94% by weight of water.

7 Claims, No Drawings

LIQUID DETERGENT COMPOSITION

BACKGROUND OF THE INVENTION

1. Field of the invention

This invention relates to a liquid detergent composition, more particularly to a liquid detergent composition for cleaning food, dinnerware, and kitchen utensils.

2. Description of the related art

Food, such as vegetables and fruits, are normally contaminated with pollutants, such as pesticides, fertilizers, preservatives, bacteria, dirt, etc., and has to be rinsed before serving or cooking. Dinnerware or kitchen utensils also have to be cleaned after use prior to storage.

Commercially available detergents for cleaning food, dinnerware, or kitchen utensils are mainly classified into two classes of detergents namely petrochemical surfactant-based detergents, such as alkyl-benzene sulfonated surfactants, and coconut oil-based detergents. The coconut oil of the coconut oil-based detergents can be derived from coconut oil, coconut oil alcohol, or coconut oil aliphatic acid derivatives.

An example of the petrochemical surfactant-based detergents was described in U.S. Pat. No. 4,140,649, which disclosed a non-toxic and hypotonic composition to be added to washwater to eliminate contaminants and pollutants from the surfaces of food and fodder. A portion of the above described composition contains 1 to 10 wt % of sulfate or sulfonate compounds.

While petrochemical surfactant-based detergents can provide a good cleansing action, such detergents tend to adhere to the surfaces of washed objects, such as food, dinnerware, or the kitchen utensils, after washing, and are not easily removed with water. As such, they may cause health problem if they enter the human body via these objects. In addition, waste water due to use of this type of detergents may result in significant pollution to the environment.

An example of the coconut oil-based detergents was described in U.S. Pat. No. 4,808,330, which disclosed a non-toxic detergent composition for effectively removing pollutants such as residual toxicities, bacteria, and fungi, from food surfaces. A portion of the above described composition contains from 8 to 25 wt % of coconut oil.

While the coconut oil-based liquid detergent composition described in U.S. Pat. No. 4,808,330 may be less harmful to the human body and to the environment as compared to the petrochemical surfactants-based detergents, the coconut oil used in such a composition is immiscible with water, and requires addition of a large amount of alcohol to emulsify coconut oil in water. Since the thus obtained liquid detergent is present as an emulsion, and does not have a transparent appearance, it is not suitable for acceptance as a commercial product by consumers. Moreover, the sodium chloride used as a buffering medium for stabilizing the coconut oil and the alcohol in the above described detergent composition has an adverse effect on the aroma of foods upon cleaning.

SUMMARY OF THE INVENTION

Therefore, it is an object of the present invention to provide a liquid detergent composition that has a transparent appearance, and that is effective as a cleaning agent for removing pollutants from the surfaces of food, dinnerware, and kitchen utensils.

Accordingly, a liquid detergent composition of this invention comprises: (1) 0.5 to 5% by weight of citrate; (2) 0.5 to 10% by weight of alcohol; (3) 5 to 15% by weight of cocinin; and (4) 70 to 94% by weight of water.

DETAILED DESCRIPTION OF THE PREFERRED EMBODIMENTS

The present invention proposes a liquid detergent composition comprising (1) 0.5 to 5% by weight of citrate; (2) 0.5 to 10% by weight of alcohol; (3) 5 to 15% by weight of cocinin; and (4) 70 to 94% by weight of water.

The cocinin used in the liquid detergent composition of this invention provides major cleansing action for cleaning food, dinnerware, or kitchen utensils. Oil or grease which adheres to food surfaces is formed into an emulsion upon contacting with the cocinin, and then dissolves in the washing water upon cleaning. An example of cocinin used in the liquid detergent composition of this invention is a condensation product of cocinic acid with ethylene oxide. The above described cocinic acid preferably contains 70 to 76% by weight of $C_{12}$ fatty acid and 24 to 30% by weight of $C_{14}$ fatty acid. Since the cocinin contains oleophilic groups and hyrophilic groups as well, it can be miscible with water and thus form a transparent liquid mixture with the latter. Such characteristic permits the liquid detergent composition of this invention to have a transparent appearance. The cocinic acid is preferably derived from natural coconut oil.

The citrate used in the liquid detergent composition of this invention functions as a sequestering agent which can react with calcium and magnesium ions in hard water or with metal oxides which adhere to food to form a complex that dissolves in water, thereby preventing precipitation from taking place upon cleaning. In addition, the citrate also acts as a buffering medium for stabilizing the cocinin. The citrate used in the liquid detergent composition is preferably sodium citric acid which is preferably obtained from natural sources.

The alcohol is used in the liquid detergent composition of this invention to provide sterilizing and cleaning actions. The alcohol is preferably selected from the group consisting of methanol, ethanol, propanol, and butanol, and more preferably ethanol obtained from natural sources.

Optional components, such as coloring agents, perfumes, thickeners, anti-oxidants, and enzymes, can be added in the liquid detergent composition of this invention.

The invention is described in greater detail with the following non-limiting examples.

EXAMPLE 1

A preferred embodiment is illustrated in this example. 70 g of water was charged in a one liter flask equipped with a stirrer, and 5 g of sodium citric acid was added thereto and was completely dissolved in the water by stirring. 10 g of ethanol was added to the above mixture, and 15 g of polyoxyethylene alkyl (coconut fatty acid) ester (a cocinin product available from Witco Asia Pacific Pte Ltd) was slowly added into the flask with stirring at a low speed for about 30 minutes to obtain a transparent liquid detergent composition of this invention. The preparation was carried out at room temperature and one atmospheric condition.

The thus obtained detergent composition was tested for its cleaning effect in removing pesticide from the surface of grapes (Test A) and the bacteria on the surface of grapes (Test B).

Test A

Tokuthion (a pesticide which contains O-ethyl-2,4-dichlorophenyl-S-n-butyl-disulfophosphate, and which is available from Hsin-Non Corporation, Taiwan, R.O.C.) was diluted 500 times with water. The diluted Tokuthion solution was sprayed uniformly on a bunch of grapes of similar sizes for the following experiments. A portion of the sprayed grapes was randomly selected as calibration sample. The remaining sprayed grapes were exposed outdoors for 24 hours, and a portion of the exposed grapes was randomly selected as a first set of samples (Sample #1). Another portion of the exposed grapes were randomly selected, and was washed with water to obtain a second set of samples (Sample #2). The detergent composition of Example 1 was diluted 100 times with water to yield a diluted detergent solution. A portion of the remaining exposed grapes was randomly selected, and was washed with the diluted detergent solution of this invention to yield a third set of samples (Sample #3).

The above described washing operation was carried out by taking one grape each time from the three sets of samples and putting the same into 100 ml of water or the diluted detergent solution, stirring the latter with a shaker for 30 seconds, and taking out the washed grape. The above washing steps were repeated until all of the grapes of the three sets of samples had been washed.

The levels of the Tokuthion that remain on the surfaces of washed (Samples #2 and 3) and unwashed grapes (Sample #1) were determined by biochemical detecting method via a spectrometer. The calibration sample was also measured according to the aforementioned method so as to calculate the level of the Tokuthion of each grape of the three sets of samples. The average level of the Tokuthion that remain on the surface of each grape for each of the three sets of samples was calculated, and is listed in Table 1.

TABLE 1

| | Average level of Tokuthion that remain on each grape, % |
|---|---|
| Sample #1 | 100 |
| Sample #2 | 59 |
| Sample #3 | 5.5 |

As shown in Table 1, the grape that was exposed outdoors but that was not washed with water or diluted detergent solution (Sample #1) contained 100% in an average of the Tokuthion that is originally present on the surface of the grape, and the grape that was exposed outdoors but that was washed with water (Sample #2) has been removed with 41% (59% was remained) in an average of the Tokuthion. On the contrary, the grape that was exposed outdoors and washed with the diluted detergent solution of this invention (Sample #3) has been removed with 94.5% (5.5% was remained) in an average of the Tokuthion.

Test B

Fresh grapes purchased from a market were prepared in this test. A detergent composition was prepared as in Example 1, and was diluted 100 times with sterilized water to give a diluted detergent solution. A grape (Sample #4) was randomly selected from the fresh grapes, and was washed with the diluted detergent solution in the same manner as that in Example 1. Another grape (Sample #5) was also randomly selected from the fresh grapes, and was washed with sterilized water in the same manner. The washed grapes (Samples #4 and 5) and another unwashed grape (Sample #6 which was selected randomly from the fresh grapes without washing) were separately inoculated in three blood agar plates. The three inoculums were incubated at 37° C. for 24 hours. Table 2 shows the result of the incubation.

TABLE 2

| | Colonies of bacteria observed, CFU*/g |
|---|---|
| Sample #4 | No colony of bacteria observed |
| Sample #5 | $1.3 \times 10^2$ |
| Sample #6 | $3.7 \times 10^3$ |

*CFU/g: colony formation units/g

Table 2 shows that the grape that was washed with the detergent solution of this invention can effectively remove the bacteria that adhered to the surface of the grape.

EXAMPLES 2 to 16

Examples 2 to 16 were carried out to illustrate the cleansing effect of the detergent composition of this invention. The compositions of Examples 2 to 16 were prepared using the same preparation steps and conditions as in Example 1. These compositions and the composition of Example 1 were diluted 100 times with water, and were then used to wash fresh grapes that were purchased from a market to remove white pollutant that adhered to the surface of the grapes. The white pollutant has been identified as containing mostly sugar which comes from the interior of grapes.

The removal of the white pollutant from the surfaces of the grapes was observed, and was ranked with notations "0" which indicates the white pollutants being essentially not removed at all, "1" which indicates the white pollutants being about half removed, and "2" which indicates the white pollutants being essentially completely removed. The results are shown in Table 3.

TABLE 3

| | Composition wt % | | | | |
|---|---|---|---|---|---|
| | Sodium citric acid | ethanol | cocinin | water | ranking |
| Example 2 | 0.0 | 10.0 | 15.0 | 75.0 | 1 |
| Example 3 | 0.5 | 10.0 | 15.0 | 74.5 | 1 |
| Example 4 | 1.0 | 10.0 | 15.0 | 74.0 | 1–2* |
| Example 5 | 2.0 | 10.0 | 15.0 | 73.0 | 2 |
| Example 6 | 3.0 | 10.0 | 15.0 | 72.0 | 2 |
| Example 7 | 4.0 | 10.0 | 15.0 | 71.0 | 2 |
| Example 8 | 5.0 | 0.5 | 15.0 | 79.5 | 1 |
| Example 9 | 5.0 | 2.0 | 15.0 | 78.0 | 1 |
| Example 10 | 5.0 | 4.0 | 15.0 | 76.0 | 1 |
| Example 11 | 5.0 | 6.0 | 15.0 | 74.0 | 1–2 |
| Example 12 | 5.0 | 8.0 | 15.0 | 72.0 | 2 |
| Example 13 | 5.0 | 10.0 | 0.0 | 85.0 | 1 |
| Example 14 | 5.0 | 10.0 | 5.0 | 80.0 | 1–2 |
| Example 15 | 5.0 | 10.0 | 10.0 | 75.0 | 2 |
| Example 1 | 5.0 | 10.0 | 15.0 | 70.0 | 2 |

*1–2: the removal of the white pollutant is between "1" and "2".

Table 3 shows that the detergent composition of this invention comprises preferably about 0.5 to 5% by weight of citrate, about 0.5 to 10% by weight of alcohol, about 5 to 15% by weight of cocinin, and about 70 to 94% by weight of water, and more preferably about 2 to 5% by weight of citrate, about 6 to 10% by weight of alcohol, about 5 to 15% by weight of cocinin, and about 70 to 87% by weight of water.

With the invention thus explained, it is apparent that various modifications and variations can be made without departing from the spirit of the present invention. It is therefore intended that the invention be limited only as recited in the appended claims.

What is claimed is:

1. A liquid detergent composition comprising:

(1) 0.5 to 5% by weight of citrate;

(2) 0.5 to 10% by weight of alcohol;

(3) 5 to 15% by weight of cocinin; and (4) 70 to 94% by weight of water.

2. The liquid detergent composition of claim 1, wherein said alcohol is selected from the group consisting of methanol, ethanol, propanol, and butanol.

3. The liquid detergent composition of claim 1, wherein said alcohol is ethanol.

4. The liquid detergent composition of claim 1, wherein said cocinin is a condensation product of cocinic acid with ethylene oxide.

5. The liquid detergent composition of claim 4, wherein said cocinic acid contains 70 to 76% by weight of $C_{12}$ fatty acid and 24 to 30% by weight of $C_{14}$ fatty acid.

6. The liquid detergent composition of claim 5, wherein the ratio of said ethylene oxide to said cocinic acid is in the range of from 7:1 to 10:1.

7. The liquid detergent composition of claim 1, wherein said citrate is sodium citric acid.

* * * * *